US006079639A

United States Patent [19]

Barbato

[11] Patent Number: 6,079,639

[45] Date of Patent: Jun. 27, 2000

[54] AUXILIARY HANDLE WITH LATCHING TRIGGER FOR POWER WASHER PRESSURE GUN

[76] Inventor: Scott M. Barbato, 51 Main St., Foxboro, Mass. 02035

[21] Appl. No.: 09/149,519

[22] Filed: Sep. 8, 1998

[51] Int. Cl.[7] ..... B05B 9/00

[52] U.S. Cl. ..... 239/525; 239/526; 251/90; 251/116

[58] Field of Search ..... 239/525, 526, 239/529; 251/90, 114, 116

[56] References Cited

U.S. PATENT DOCUMENTS

| | | | |
|---|---|---|---|
| 55,789 | 6/1866 | Thompson . | |
| 2,124,039 | 7/1938 | Mitchell et al. . | |
| 2,637,236 | 5/1953 | Vergnani et al. . | |
| 2,720,900 | 10/1955 | Quist . | |
| 3,253,850 | 5/1966 | Trusty . | |
| 3,585,704 | 6/1971 | Schroeder . | |
| 4,048,877 | 9/1977 | Undin . | |
| 4,344,215 | 8/1982 | Dearman . | |
| 4,353,240 | 10/1982 | Undin et al. . | |
| 4,381,661 | 5/1983 | Wiener et al. . | |
| 4,821,610 | 4/1989 | Redmon, Jr. et al. . | |
| 5,040,769 | 8/1991 | Wilber et al. | 251/90 |
| 5,427,004 | 6/1995 | Monaco . | |
| 5,636,789 | 6/1997 | Shook | 239/526 |

FOREIGN PATENT DOCUMENTS

454189 A2 1/1988 European Pat. Off. .

OTHER PUBLICATIONS

Suttner America—Page from www.suttner.com website no dateavailable.

Suttner America—sales brochure, 2 pages, no date available.

*Primary Examiner*—Steven O. Douglas

*Attorney, Agent, or Firm*—John L. Lee

[57] ABSTRACT

An auxiliary handle with a latching trigger is provided for a power washer pressure gun. The latching trigger is operable to hold the gun trigger in the "on" position. The latching trigger avoids fatigue in the hand of the operator of a conventional power washer pressure gun resulting from the need to hold the gun trigger in the "on" position during washing. The latching trigger includes a quick release mechanism having a ratchet with a notch. A wrist brace with a rigid support plate and a flexible strap is provided, attached to the auxiliary handle. The latching trigger includes a tong shaped to partially encircle the gun trigger thereby preventing disengagement of the auxiliary handle from the gun when the gun trigger in the "on" position.

9 Claims, 3 Drawing Sheets

AUXILIARY HANDLE WITH LATCHING TRIGGER FOR POWER WASHER PRESSURE GUN

TECHNICAL FIELD

The invention relates generally to handle and trigger systems for holding and operating manually-operated power tools.

BACKGROUND OF THE INVENTION

A power washer pressure gun produces a powerful, high velocity stream of water which can be very dangerous if directed at a person. Thus, it is desirable to provide with such equipment safety features including rapid shut-off of flow to reduce the risk of injury to the operator and others. Additionally, when using conventional designs of power washer pressure guns, the operator is quickly fatigued. Operator fatigue is caused by the need to hold the trigger tightly against force at the trigger resulting from back pressure from the high pressure water acting on the flow valve. It is also caused by the need to hold the trigger tightly for an extended period of time, and by the need to overcome the tendency of the gun to twist and turn as a result of the strong recoil of the gun. The user must at all times accurately control the direction of the stream of water to avoid causing injury to others.

Handle systems having compound-action gripping mechanisms and quick release mechanisms are widely used in pliers, and in crimping and clamping tools.

U.S. Pat. No. 3,253,850 to Trusty, discloses a quick releasable carrying device having a handle 37, a toggle 19, and a pair of gripping jaws 13 and 15. The device permits easy handling of bulky objects, and provides means for easy release. Release is effected by flicking toggle release extension 51 with the index finger of the grasping hand. (col. 2, lines 39–42).

U.S. Pat. No. 4,353,240 to Undin et al. discloses a crimping tool with a four-pivot compound-action gripping mechanism and a pawl and ratchet mechanism, including a ratchet 24 and a pawl 34 mounted on handle 21. (col. 5, lines 35–47).

U.S. Pat. No. 4,381,661 to Wiener et al. discloses a crimping tool with a four-pivot compound-action gripping mechanism and a pawl and ratchet mechanism similar to that disclosed in U.S. Pat. No. 3,253,850.

U.S. Pat. No. 4,048,877 describes more fully the pawl and ratchet mechanism in U.S. Pat. Nos. 4,353,240 and 4,381,661. (col. 4, lines 30–44). U.S. Pat. No. 4,048,877 is hereby incorporated herein by reference.

SUMMARY OF THE INVENTION

A first object of the invention is to provide a means for reducing operator fatigue by reducing physical stress on the operator's fingers, hands and wrists.

A second object of the invention is to minimize the risk of injury to the operator and others during operation of a power washer pressure gun.

A third object of the invention is to provide a means for reducing physical stress on the operator's fingers, hands and wrists by using a latching trigger.

A fourth object of the invention is to minimize the risk of injury to the operator and others by using a latching trigger with a quick release mechanism, and providing means for holding the operator's hand proximate to the quick release mechanism while washing.

The invention provides an auxiliary handle with a latching trigger for a conventional power washer pressure gun of the type designed for two-handed operation.

A preferred embodiment of the present invention provides an auxiliary handle with a latching trigger operable to hold the gun trigger of a conventional power washer pressure gun in the "on" position, such as to eliminate any need for the operator to apply continuous manual force during washing.

The preferred embodiment includes a handlebar having a distal end portion adapted for removable attachment to the gun and a proximal end portion with a handle grip for gripping by the one hand; a tong pivotally connected to the handlebar and shaped for operational contact with the gun trigger; and a latching trigger coupled to the tong and to the handlebar such that the latching trigger is operable to hold the gun trigger in the "on" position. One end of the handlebar is shaped to fit an aperture in the housing of the gun.

The preferred embodiment further includes the following design features. It includes a wrist brace attached to the auxiliary handle, the wrist brace including a rigid support plate and a flexible strap. The latching trigger includes a tong shaped to partially encircle the gun trigger such that the tong prevents disengagement of the auxiliary handle from the gun when the gun trigger in the "on" position. The latching trigger further includes a trigger arm, a pawl pivotally mounted to the trigger arm, a ratchet proximate to the pawl and pivotally attached at a first end to the trigger arm and at a second end to the handlebar, and a spring connected between the trigger arm and the pawl. The latching trigger further includes a spring connected between the tong and the handlebar, and the ratchet has a quick release notch.

In an alternative embodiment, one end of the handlebar is shaped to grip the rear handle of the gun.

DETAILED DESCRIPTION OF THE INVENTION GENERAL

Figure 1:
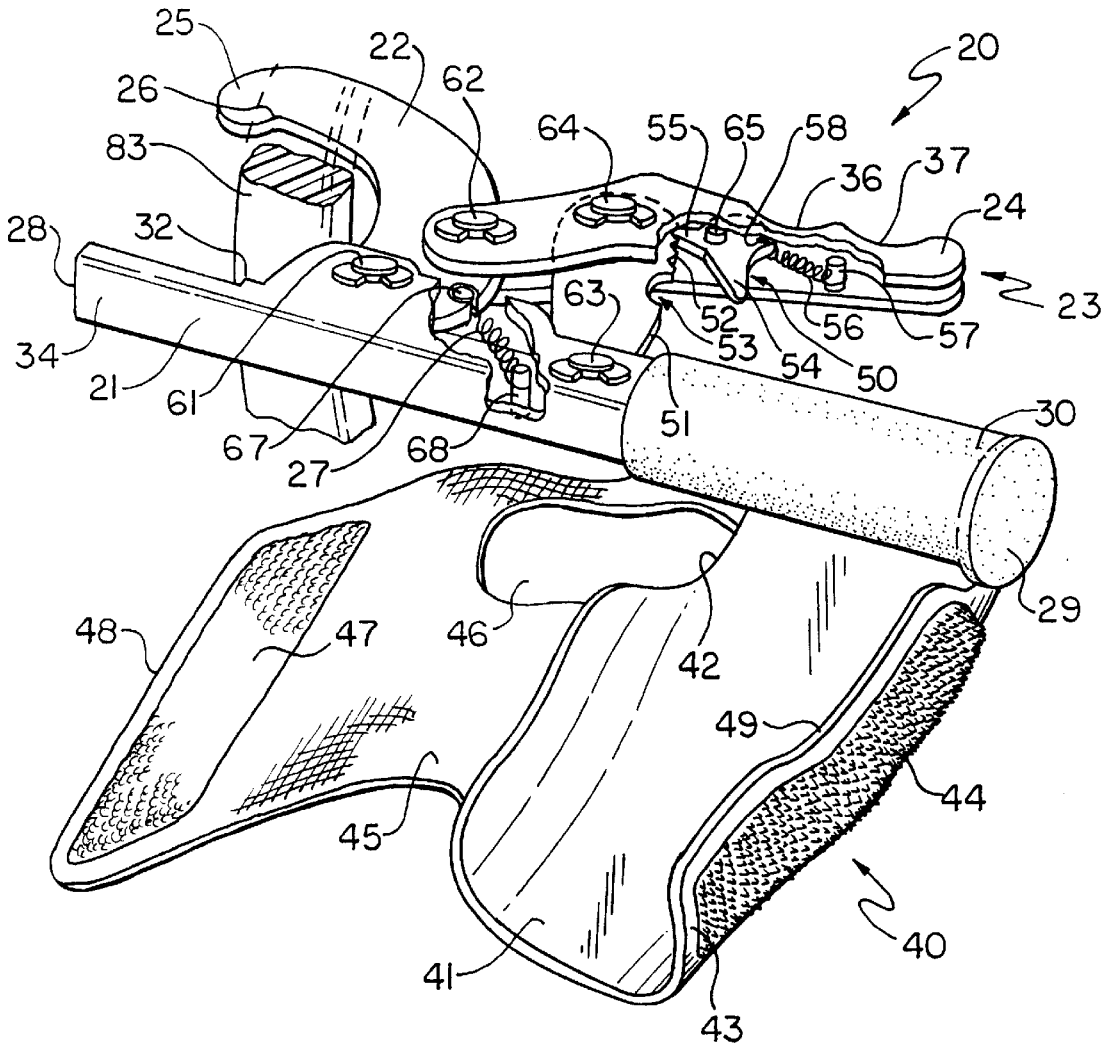
FIG. 1 is a perspective view of an auxiliary handle with a latching trigger according to a first embodiment of the present invention.
Figure 2:
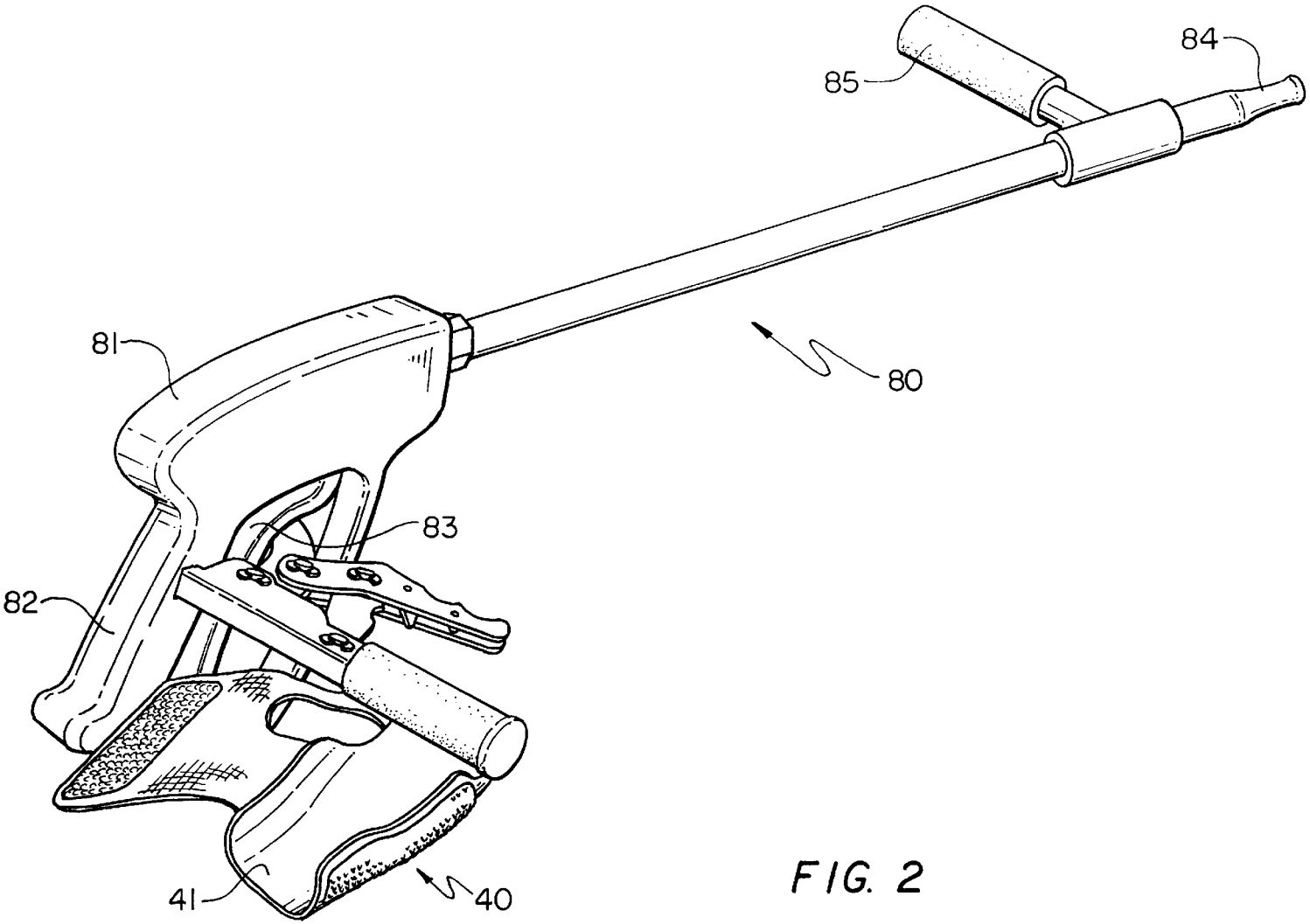
FIG. 2 is a perspective view of the auxiliary handle of FIG. 1 fitted to an otherwise conventional power washer pressure gun.
Figure 3:
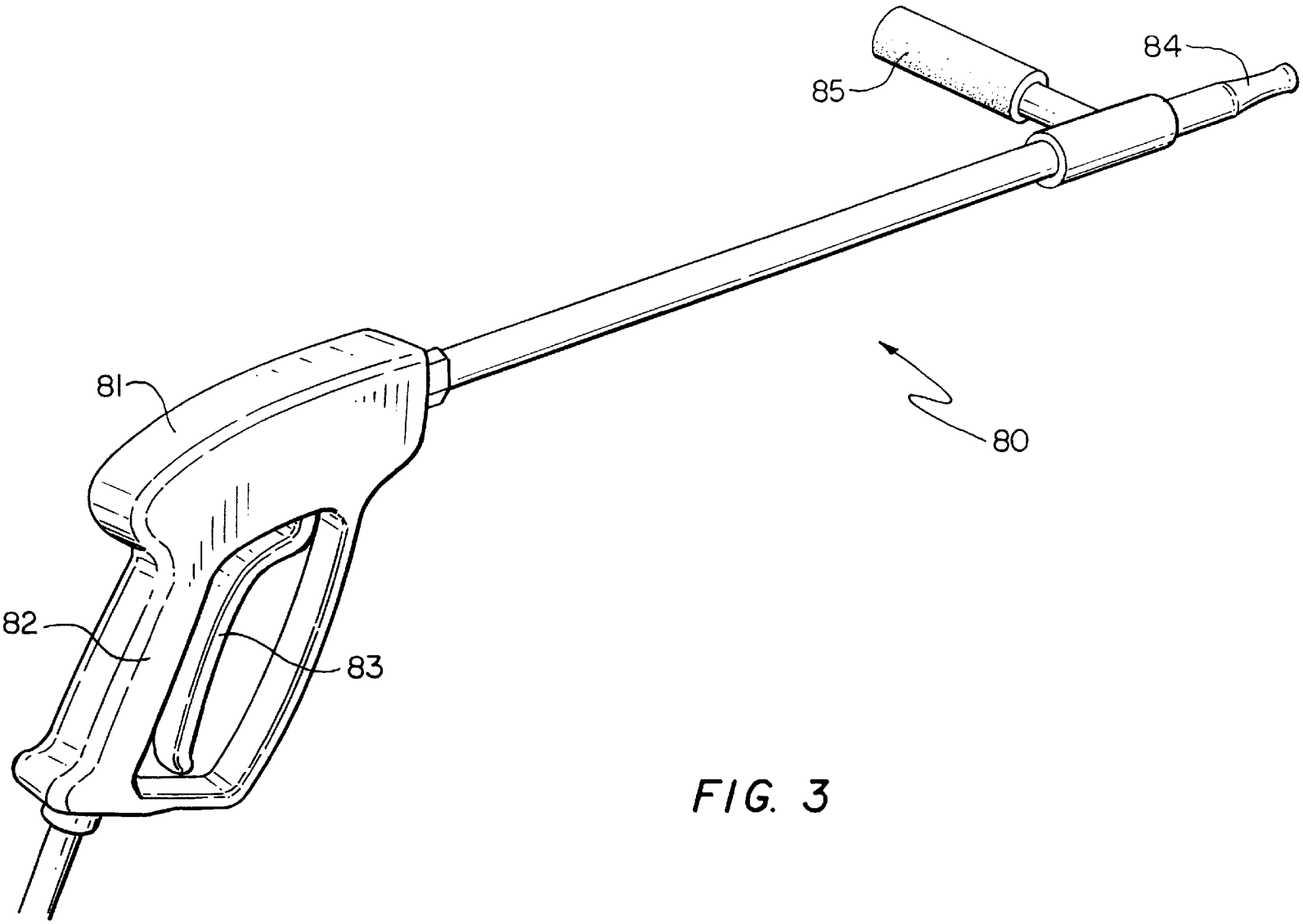
FIG. 3 shows a conventional (prior art) power washer pressure gun.

A preferred embodiment of the present invention, illustrated in FIG. 1, provides an auxiliary handle with a compound-action latching trigger and a quick release mechanism for use with an otherwise conventional power washer pressure gun. FIG. 2 shows the auxiliary handle fitted to a conventional power washer pressure gun. FIG. 3 shows a conventional power washer pressure gun alone.

A typical conventional gun 80, as illustrated in FIG. 3, includes a housing 81 defining a rear handle 82, a gun trigger 83 with an "off" position and an "on" position, a nozzle 84 mounted to the housing, and a forward handle 85 mounted fixedly with respect to the nozzle. The gun of FIG. 3 is adapted for two-handed operation with the operator's right hand gripping rear handle 82 and the operator's left hand gripping forward handle 85. The gun trigger is coupled to operate a valve (not shown) that controls water flow to the nozzle. In a gun of the type, the need to apply continuous manual force to hold the gun trigger in the "on" position causes fatigue in the hand of the operator, particularly in the fingers of the operator's right hand.

Referring to FIG. 1, auxiliary handle 20 includes a handlebar 21 adapted for removable attachment to housing 81 at rear handle 82, latching trigger 23, handle grip 30, and wrist brace 40. Latching trigger 23 includes tong 22 pivotally connected to the handlebar, trigger arm 24, and pawl and ratchet mechanism 50. Pawl and ratchet mechanism 50 includes ratchet 51 with quick release notch 53, pawl 54, and spring 56.

The latching trigger is adapted for movement of the gun trigger between an "off" position and an "on" position by finger-force, for holding the gun trigger in an "on" position in the absence of finger-force, and for movement of the gun trigger between an "on" position and an "off" position by finger-force.

Squeezing trigger arm 24 moves tong 22 and puts gun trigger 83 of the power washer pressure gun in the "on" position (nozzle valve open). The gun trigger is held in the "on" position by pawl and ratchet mechanism 50.

After the gun trigger has been put in the "on" position, mechanism 50 holds the gun in the "on" condition. This eliminates the need for the operator to apply continuous manual force to a trigger during washing. Application of finger-force to the trigger arm when the gun trigger is in the "on" position moves the pawl further along the ratchet until the pawl encounters the quick release notch. When this happens, the pawl and ratchet mechanism releases the trigger arm and the gun trigger returns to its "off" position (nozzle valve closed). Thus, the latching trigger provides comfortable one-handed on/off control of the flow of water.

Each of items 21, 22, 24, and pivots 61–64 form part of a force transmitting path extending between a region of the trigger arm to which the operating force is applied and tong 22 from which the force is transferred to squeeze gun trigger 83.

In the embodiment of FIG. 1, keyed portion 34 of handlebar 21 is removably attached to housing 81 through a rectangular keyed slot cut into and passing through rear handle 82 behind the pipe (not shown) that carries pressurized water through the housing. Shoulder 32 butts up against the proximate side of the housing. When the gun is "on", the auxiliary handle is locked to the housing by lip 26 of the tong clasping gun trigger 83. Operationally, this means that the auxiliary handle is prevented from separating from the gun while the gun is "on". By virtue of the rectangular shape of keyed portion 34, the auxiliary handle is prevented from rotating with respect to the gun.

FIG. 1 also shows wrist brace 40 with its support plate 41, and its strap 45. Wrist brace 40 is preferably a strap-on wrist brace, sized to embrace the operators wrist using hook and loop straps 44 and 47. The wrist brace serves to cushion the recoil from high pressure water flow. Support plate 41 is shaped to define a cutaway 42 to accommodate the operator's thumb, a raised side 43 to support the side of the operator's hand, and a hook pad 44. Strap 45 is preferably a single strap adapted for one-handed fastening and unfastening. Strap 45 includes a thumb hole 46 allowing the operator's thumb to pass through, and a loop pad 47. Prior to engagement of the auxiliary handle with the power washer pressure gun and operation of the latching trigger, outer edge 48 of the strap is wrapped over the operator's wrist and over raised edge 49, such that loop pad 47 engages with hook pad 44.

FIG. 1 further shows detail of pawl and ratchet mechanism 50, in which ratchet 51 is pivotally mounted to handlebar 21 and trigger arm 24 by pivots 63 and 64 respectively. In operation, trigger arm 24 is held in the "on" position by detent 55 of pawl 54 engaging in ratchet teeth 52 of ratchet 51. Spring 56, which is attached at one end to pawl 54 at attachment point 58 and at the other end to trigger arm 24 via post 57, exerts the force needed to hold trigger arm 24 in the "on" position. Thus, the operator is not required to maintain any finger pressure on the trigger arm during washing.

Comfortable one-handed shutoff is effected by the operator squeezing trigger arm 24 until detent 55 encounters slot 53. When this happens, spring 56 causes pawl 54 to rotate about pivot 65. Lacking restraint from detent 55, spring 27 returns tong 22 and trigger arm 24 to the "off" position, releasing the grip of tong 22 on trigger 83, thereby closing the valve. The pawl and ratchet mechanism operates to prevent opening movement of the tong before the trigger arm has moved from its "on" position to a more squeezed position. A pawl and ratchet mechanism of this kind is more fully described in U.S. Pat. No. 4,048,877. (col. 4, lines 30–44).

In a first alternative embodiment, a simple gripper in the shape of a tuning fork replaces the keyed portion of the handlebar. This simple gripper is pushed on to the rear handle such as to grip the rear handle, thereby locating the latching trigger with respect to the housing and preventing rotation of the auxiliary handle with respect to the power washer pressure gun. This embodiment does not require modification of the conventional power washer pressure gun.

In a second alternative embodiment, a latching trigger similar to that illustrated in FIG. 1 could be mounted to the forward handle. In this embodiment, the trigger arm could be coupled either by rigid drive or by cable drive to the gun trigger.

In a variant these embodiments, the latching trigger could be configured as a single-finger-grip mechanism, that could be similar in appearance to the handlebar-mounted cable-linked gear change trigger used in three-speed bicycles having a wheel-hub gear mechanism.

What is claimed is:

1. An auxiliary handle for a power washer pressure gun of the type designed for two-handed operation, wherein the gun includes a housing defining a rear handle, a gun trigger pivotally mounted to the housing and having an "on" position and an "off" position, a nozzle mounted to the housing, and a forward handle mounted to the nozzle, and wherein the gun is adapted for washing with the rear handle gripped by one hand of the operator and the forward handle gripped by the other hand, said auxiliary handle comprising: a handlebar having a distal end portion adapted for attachment to the gun and a proximal end portion with a handle grip for gripping by the one hand; a tong pivotally connected to the handlebar and shaped for operational contact with the gun trigger; and a latching trigger coupled to the tong and to the handlebar such that the latching trigger is operable to hold the gun trigger in the "on" position; whereby any need to apply continuous manual force to hold the gun trigger in the "on" position is eliminated.

2. An auxiliary handle according to claim 1, wherein the distal end portion is adapted for removable attachment to the gun.

3. An auxiliary handle according to claim 1, further comprising a wrist brace attached to the auxiliary handle.

4. An auxiliary handle according to claim 3, wherein the wrist brace includes a rigid support plate and a flexible strap.

5. An auxiliary handle according to claim 1, wherein the tong is shaped to partially encircle the gun trigger such that the tong prevents disengagement of the auxiliary handle from the gun when the gun trigger is in the "on" position.

6. An auxiliary handle according to claim 1, wherein the latching trigger includes a trigger arm, a pawl pivotally mounted to the trigger arm, a ratchet proximate to the pawl and pivotally attached at a first end to the trigger arm and at a second end to the handlebar, and a spring connected between the trigger arm and the pawl.

7. An auxiliary handle according to claim 5, further comprising a spring connected between the tong and the handlebar; and wherein the ratchet has a quick release notch.

8. An auxiliary handle according to claim 1, wherein the distal end portion of the handlebar is shaped to fit an aperature in the housing of the gun.

9. An auxiliary handle according to claim 1, wherein the distal end portion of the handlebar is shaped to grip at least a portion of the gun.

* * * * *